US005803046A

United States Patent [19]

Bolander et al.

[11] Patent Number: 5,803,046

[45] Date of Patent: Sep. 8, 1998

[54] IGNITION TIMING CONTROL

[75] Inventors: William Joseph Bolander, Ortonville; Robert Leonard Morris, Livonia, both of Mich.

[73] Assignee: General Motors Corporation, Detroit, Mich.

[21] Appl. No.: 741,004

[22] Filed: Oct. 31, 1996

[51] Int. Cl.[6] ..... F02P 5/14

[52] U.S. Cl. ..... 123/425

[58] Field of Search ..... 123/425, 416, 123/417, 418, 643; 364/431.03, 431.02; 307/304

[56] References Cited

U.S. PATENT DOCUMENTS

| | | | |
|---|---|---|---|
| 2,924,633 | 2/1960 | Sichling et al. | 123/643 |
| 4,317,055 | 2/1982 | Yoshida et al. | 307/304 |
| 4,351,306 | 9/1982 | Luckman et al. | 123/417 |
| 4,649,881 | 3/1987 | Long | 123/418 |
| 4,881,512 | 11/1989 | Erskine et al. | 123/628 |
| 4,893,244 | 1/1990 | Tang et al. | 364/431.03 |
| 5,291,409 | 3/1994 | Richardson et al. | 364/431.07 |
| 5,385,516 | 1/1995 | Grange et al. | 477/107 |

*Primary Examiner*—Raymond A. Nelli
*Attorney, Agent, or Firm*—Michael J. Bridges

[57] ABSTRACT

Automotive internal combustion engine ignition timing control operations for varying timing of engine cylinder combustion chamber ignition events models the lead-lag combustion chamber temperature change profile under a transition from a first to a second engine operating condition and varies ignition timing following the transition in response to the temperature change profile. The lead-lag profile is implemented by applying a step change in ignition timing followed by a more gradual timing change, such as along a first order lag trajectory, toward a final ignition timing following the transition, and is updated in synchronism with engine cylinder events to account for a dependence on engine speed.

10 Claims, 3 Drawing Sheets

IGNITION TIMING CONTROL

FIELD OF THE INVENTION

This invention relates to automotive internal combustion engine control and, more particularly, to internal combustion engine ignition timing control.

BACKGROUND OF THE INVENTION

The timing of ignition events in an internal combustion engine is commonly scheduled as a function of engine speed and engine load to account for, among other parameters, engine cylinder combustion chamber temperature. Engine cylinder combustion chamber temperature varies with engine load. For steady state engine operating conditions characterized by a relatively constant engine load, combustion chamber temperature is substantially constant. Calibration procedures are known to be applied to establish desired ignition timing values for various engine speed and load values under steady state calibration conditions. The calibrated ignition timing values are stored in memory devices following calibration, and are accessed from such devices during engine operation as a function of a current engine speed and load value. Engine ignition timing control using such accessed timing values yields desirable performance under steady state operating conditions. However, under transient operation conditions, such as conditions under which engine load is changing, transient combustion chamber temperature is not properly modeled under such calibrated ignition timing values, resulting in substantially sub-optimal ignition timing control and reduced engine performance.

It is known that under transient engine operating conditions, an ignition timing correction may be determined as a function of change in engine load and added to a calibrated base ignition timing value that has been accessed from a memory device. Such transient compensation accounts for a lag in combustion chamber temperature away from a steady state temperature. However, it has been established that under a transient engine operating condition in which engine load changes from an initial engine load to a final engine load, the change in combustion chamber temperature does not follow a simple lag trajectory. Accordingly, under conventional transient ignition timing compensation, significant error in the estimate of combustion chamber temperature is present leading to inaccurate ignition timing control and reduced engine performance. It would therefore be desirable to increase the accuracy of estimation of combustion chamber temperature during engine transient operating conditions to minimize any loss in engine performance during such conditions.

SUMMARY OF THE INVENTION

The present invention is directed to desirable engine ignition timing control responsive to an accurate combustion chamber temperature model. More specifically, a combustion chamber temperature model is developed representing a temperature change profile between an initial temperature under initial steady state operating conditions and a final temperature under final steady state operating conditions. Accurate initial and final steady state temperature values may be determined directly, for example through a calibration process, as the measured combustion chamber temperature under the respective initial and final steady state operating conditions. As an engine operating condition moves from an initial to a final operating condition, the change in combustion chamber temperature is modeled as a lead-lag temperature change profile dependent on engine operating conditions. Accordingly, a lead-lag model is generated and stored in the form of a mathematical function or a series of values in a lookup table format. In accord with a further aspect of the invention, the stored lead-lag model includes an initial step change in temperature from the initial steady state combustion chamber temperature toward the final steady state combustion chamber temperature followed by a first order lag change in temperature to allow for a gradual approach toward the final steady state combustion chamber temperature. In accord with a further aspect of this invention, the magnitude of the step change and the time constant of the first order lag change in temperature are determined as a function of engine load, change in engine load, and engine speed.

In accord with yet a further aspect of this invention, an ignition timing control command varies with combustion chamber temperature. As an engine operating condition moves between steady state operating conditions, a lead-lag compensator is applied to an ignition timing control command to account for the combustion chamber temperature transition between initial and final steady state combustion chamber temperatures. The lead-lag compensation of ignition timing control may be applied periodically, or may be applied following engine cylinder events to expediently account for a dependence on engine speed.

BRIEF DESCRIPTION OF THE DRAWINGS

The invention may be best understood by reference to the preferred embodiment and to the drawings in which.

DESCRIPTION OF THE PREFERRED EMBODIMENT

Figure 1:
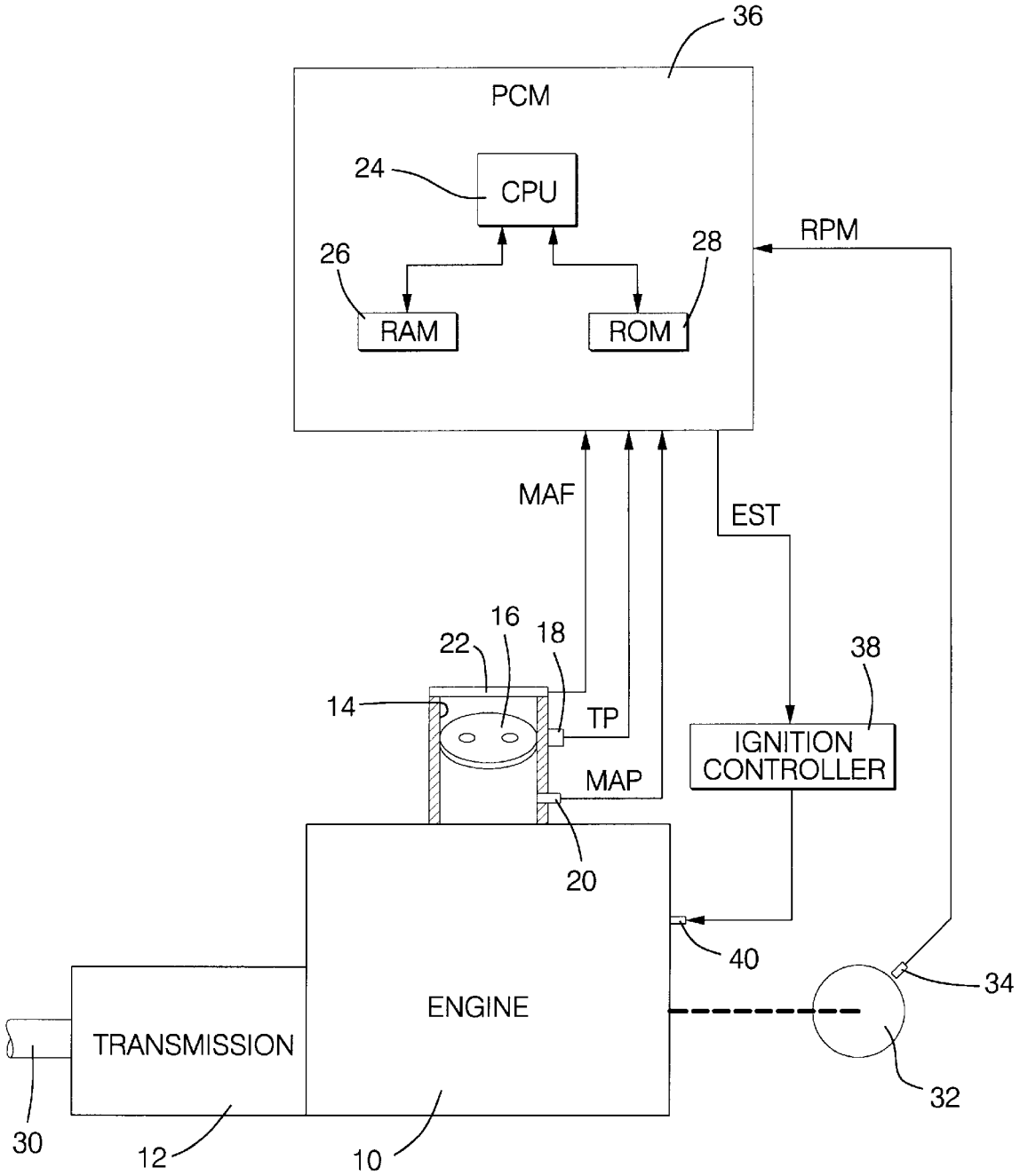
FIG. 1 is a general diagram of an internal combustion engine and ignition control hardware in accord with the preferred embodiment of this invention.

Referring to FIG. 1, internal combustion engine 10 coupled to conventional transmission 12 having output shaft 30 receives intake air through intake air bore 14 past throttle valve of the butterfly or rotary type into intake manifold 10 for distribution to a plurality of engine cylinders each having at least one conventional spark plug, one representative spark plug 40 being schematically shown. The rotational position of the throttle valve is manually or electronically controlled to vary restriction in the intake bore, the rotational position being transduced by potentiometric position sensor 18 into output signal TP. Absolute air pressure in intake manifold 30 is transduced by conventional pressure transducer 20 into output signal MAP. Mass flow rate of intake air is transduced by mass airflow sensor 22 of the hot wire or thick film type into output signal MAF. The intake air is combined with an injected fuel quantity and admitted into engine cylinders (not shown) for combustion therein to reciprocally drive pistons (not shown) within the cylinders, the pistons being mechanically linked to an engine output shaft 32, such as a crankshaft, to rotationally drive the shaft. A plurality of spaced notches or teeth (not shown) are disposed about the shaft 32 in position to pass in proximity to a Hall effect or variable reluctance or magnetoresistive sensor 34 which is fixed in position relative to the crankshaft 32. Passage of the teeth or notches by the sensor 34 is transduced into cycles of a sensor output signal RPM, such that the frequency of the sensor output signal RPM is proportional to engine output shaft rotational rate (engine speed). In an N cylinder engine application, N/2 teeth or notches are disposed about the circumference of the output shaft 32 with an additional tooth added for engine synchronization, so that substantially each tooth or notch passage indicates an engine cylinder event which, in this embodiment, is designated as an engine cylinder top dead center event in which the piston within an engine cylinder is substantially at a top dead center position to be followed by an intake piston stroke within the cylinder.

Powertrain control module PCM 36 is provided for sequencing through powertrain control and diagnostic operations including ignition timing control operations and includes such well-known elements as a central processing unit CPU 24 including arithmetic logic circuitry and control circuitry, random access memory devices RAM 26 for fast access temporary data storage and read only memory devices ROM 28 for permanent read only data storage. The PCM 36 is activated upon manual application of ignition power thereto to execute a series of instructions stored in ROM for controlling operation of the powertrain, for diagnosing powertrain fault conditions, and for communicating with external control, diagnostic and maintenance modules, in accordance with general practice in the art.

Through PCM control operations, a spark plug ignition timing command EST is generated as a function of engine speed and load to account for individual cylinder combustion conditions which are dependent on combustion temperature. Ignition timing operations are carried out following each successive engine cylinder event, illustrated by the series of pulses 310 of FIG. 3A. For steady engine load illustrated by low and high load portions 320 and 324, respectively, of the load signal of FIG. 3B, combustion chamber temperature Tcc remains substantially constant, as illustrated by the corresponding portions 330 and 336 of the Tcc signal of FIG. 3C. Combustion temperature changes non-linearly with change in engine load during transient engine operating conditions. As engine load moves from an initial engine load to a final engine load during a transient condition, cylinder combustion chamber temperature undergoes a step change followed by a first order lag profile toward a temperature corresponding to the final engine load. Specifically, following a substantial decrease in engine load 318 (FIG. 3B), Tcc undergoes a step decrease in temperature 326 followed by a more gradual temperature decrease 328 toward a final temperature 330 corresponding to the new low engine load 320. The more gradual decrease generally follows a first order lag decrease in this embodiment. A steady state spark timing model, such as illustrated by SPKss curve of FIG. 3D, ignores the lead-lag change in Tcc by moving directly from an initial spark timing value S1 340 to a second spark timing value S2 342 following detection of the load change at time t1. Such ignition timing fails to account for the transient change in Tcc, leading to significantly sub-optimal ignition timing during the transient and reduced engine performance.

Figures 3A, 3B, 3C, 3D, 3E:
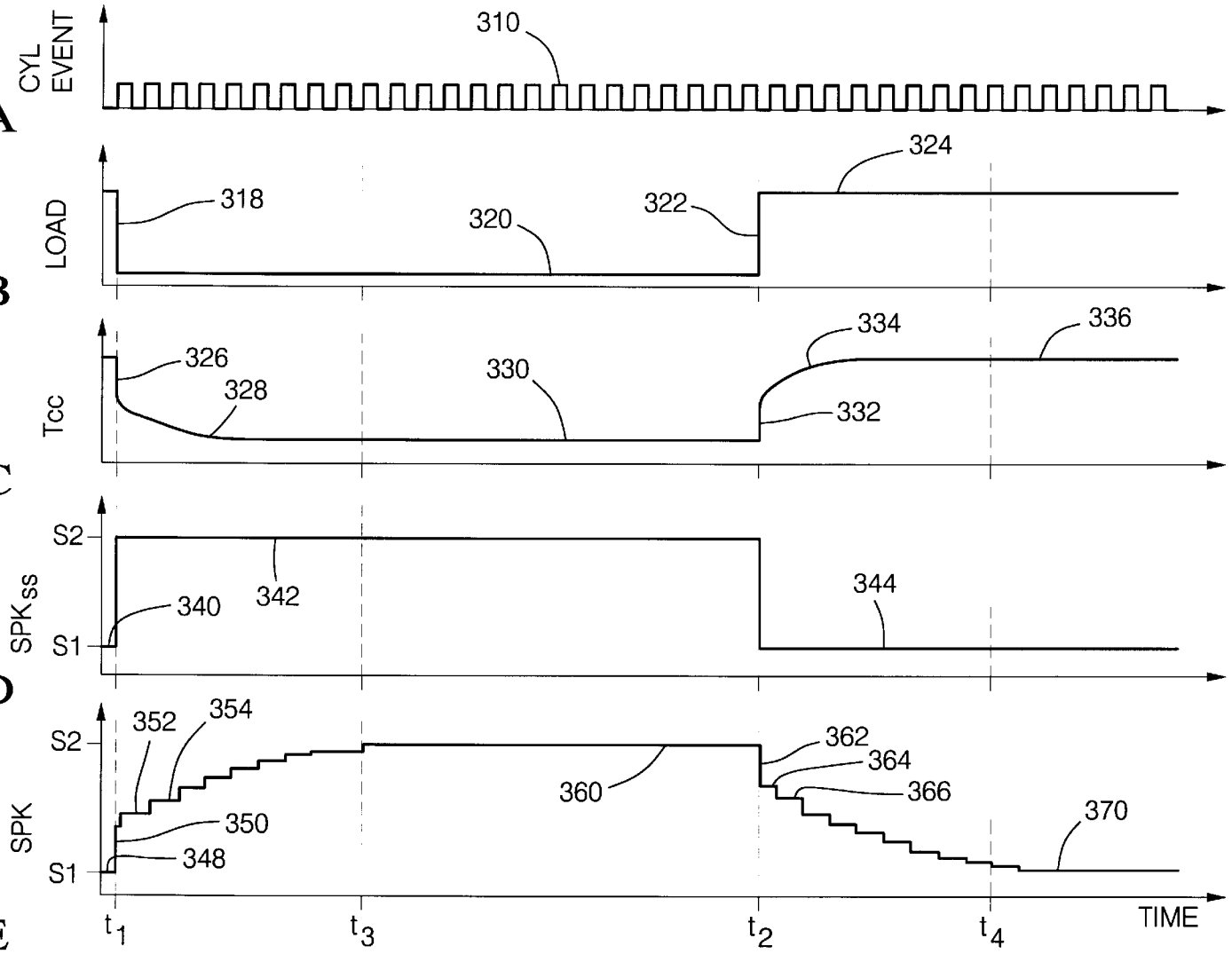
FIGS. 3A–3E are graphical diagrams illustrating engine ignition timing control parameters relied on in the operations of FIG. 2.

Accordingly, in accord with the principles of this invention, spark timing SPK, as illustrated in FIG. 3E, follows a transient timing trajectory during a detected engine transient condition to more closely model the actual combustion chamber temperature throughout the transient. Specifically, SPK step increases 350 from an initial value S1 348 following detection of the transient at time t1, and then begins a gradual increase toward a final value S2 360 at steps of decreasing magnitude which are generated through execution of ignition timing control operations triggered by each of the series of cylinder events 310. Following the step increase 350, a smaller ignition timing increase is applied to reach timing 352 at a next engine cylinder event, followed by yet a smaller increase to a reach ignition timing 354 at a next cylinder event, etc. until the final timing 360 corresponding to the new engine load 320 (FIG. 3B) is reached approximately at the time t3 combustion chamber temperature Tcc reaches a stable temperature 330 corresponding to the new engine load 320.

Likewise, following a substantial increase in engine load 322 (FIG. 3B), Tcc undergoes a step increase in temperature 332 followed by a more gradual temperature increase 334 toward a final temperature 336 corresponding to the new low engine load 324. The more gradual increase generally follows a first order lag increase in this embodiment. A steady state spark timing model, such as illustrated by SPKss curve of FIG. 3D, ignores the lead lag change in Tcc by moving directly from an initial spark timing value S2 342 to a second spark timing value S1 344 following detection of the load change at time t2. Such ignition timing, which is generally understood to be dependent on combustion chamber temperature, fails to account for the transient change in Tcc, leading to significantly sub-optimal ignition timing during the transient and reduced engine performance.

Accordingly, in accord with the principles of this invention, spark timing SPK, as illustrated in FIG. 3E, follows a transient timing trajectory during a detected engine transient condition to more closely model the actual combustion chamber temperature throughout the transient. Specifically, SPK step decreases 362 from an initial value S2 360 following detection of the transient at time t2, and then begins a gradual decrease toward a final value S1 370 at steps of decreasing magnitude which are generated through execution of ignition timing control operations triggered by each of the series of cylinder events 310. Following the step decrease 362, a smaller ignition timing decrease is applied to reach timing 364 at a next engine cylinder event, followed by yet a smaller increase to a reach ignition timing 366 at a next cylinder event, etc. until the final timing 370 corresponding to the new engine load 324 (FIG. 3B) is reached at the time t4 combustion chamber temperature Tcc reaches a stable temperature 336 corresponding to the new engine load 324.

As such, cylinder ignition timing is controlled to initially change rapidly upon sensing a transient engine operating condition and then to change along a first order lag profile toward a final ignition timing value corresponding to the final engine load. The determined ignition timing value is output in the form of a signal EST to an ignition controller 38 of any conventional design which issues a spark plug drive signal to a spark plug for a next active engine cylinder, such as spark plug 40, at the time dictated by EST for combustion of the air/fuel mixture in the active cylinder.

Figure 2:
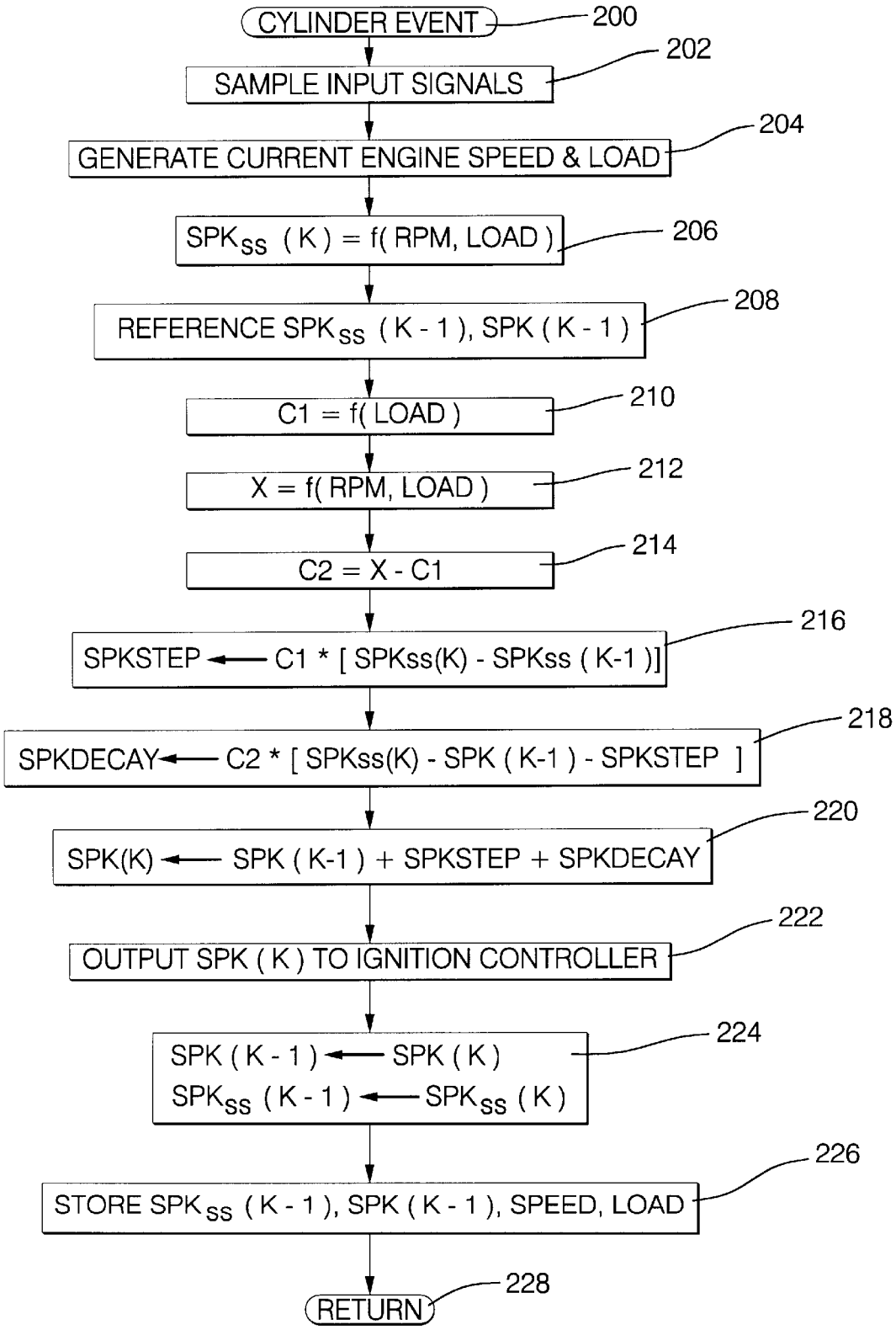
FIG. 2 is a computer flow diagram illustrating a flow of controller operations for controlling the hardware of FIG. 1 to carry out the ignition timing control of the preferred embodiment.

Referring to FIG. 2, the series of ignition control operations that are executed following occurrence of engine cylinder events are illustrated in a step by step manner and are stored as a series of instructions in ROM 28 (FIG. 1). Such control operations may be triggered by a conventional cylinder event interrupt initialized to occur following each engine cylinder top dead center event. Additional standard control, diagnostic or maintenance operations may be carried out following such interrupt, in accordance with generally understood processor-based engine controls.

More specifically, following each engine cylinder event, the operations of the routine of FIG. 2 are carried out starting at a step 200 and proceeding to sample input signals at a next step 202 including such signals as MAF, TP, MAP, and RPM of FIG. 1. Such signal samples and prior samples of such signals are applied to determine engine speed and engine load at a next step 204. Engine speed is determined directly from lag filtering of signal RPM. Engine load is determined as mass of intake air per cylinder event, which may be derived from MAF and RPM, or from signals MAP, TP and RPM in a well-known speed density procedure.

A steady state spark timing value for the current (Kth) cylinder event $SPK_{ss}(K)$ is next referenced at a step 206 from a stored schedule of such values as a function of current engine speed and load. As described, engine cylinder combustion chamber temperature is substantially constant for a given engine load and therefore a single calibrated ignition timing value may be determined through a conventional calibration process for a given engine speed and load and stored in a lookup table in ROM 28 (FIG. 1). Timing values are referenced from the stored lookup table as a function of the current engine speed and load at the step 206 corresponding to steady state operating conditions including steady combustion chamber temperature. A stored steady state spark timing command $SPK_{ss}(K-1)$ for the most recent prior ("K−1"th) cylinder event, and a spark timing command SPK(K−1) for the most recent prior cylinder event is next referenced from a memory device such as a RAM device 26 (FIG. 1) at a step 208.

A filter coefficient C1 is determined at a next step 210, for example as a function of current engine load or as a constant over all engine speeds and loads. C1 represents the amount of change in spark timing desired per engine cylinder event. A schedule of C1 values may be determined through a calibration process by monitoring the combustion chamber temperature profile for a given engine load and by matching the spark timing profile with the temperature change profile for precise combustion chamber temperate compensation throughout a transient engine operating condition.

A temporary value X is next determined at a step 212 as a function of engine speed and engine load as the magnitude of the step change in ignition timing required for a given transient operating condition, which again may be established through a conventional calibration procedure with monitoring of the initial step change in combustion temperature during transient engine operating conditions over a range of engine speeds and loads. A second filter coefficient C2 is next determined as a difference between X and C1 at a step 214. A step change in spark timing SPKSTEP is next calculated at a step 216 as follows:

$$SPK\text{STEP}=c1*[SPKss(K)-SPKss(K-1)]$$

representing any required step change in spark timing between a prior and a current steady state spark timing value, to compensate for any corresponding step change in combustion chamber temperature resulting from a transient engine operating condition in accord with the principles of this invention. Following the step 216, a spark timing decay value SPKDECAY is determined as follows:

$$SPK\text{DECAY}=C2*[SPK_{ss}(K)-SPK(K-1)-SPK\text{STEP}]$$

to provide for a gradual decrease in spark timing change to compensate a corresponding gradual decrease in combustion chamber temperature following during a transient engine operating condition.

The change in spark timing away from a most recent spark timing value SPK(K−1) is next calculated at a step 220 as follows:

$$SPK(K)=SPK(K-1)+SPK\text{STEP}+SPK\text{DECAY},$$

which provides for an inherent detection of a transient engine operating condition represented in this embodiment as a significant determined change between $SPK_{ss}(K)$ and $SPK_{ss}(K-1)$, and following such detected change, provides for lead-lag spark timing compensation through a step change in spark timing corresponding to an estimated step change in combustion chamber temperature followed by a gradually decaying spark timing change toward a final steady state timing value corresponding to an estimated gradually decaying change in combustion chamber temperature toward a final steady state temperature. As illustrated in FIG. 3E, the change in spark timing is bi-directional. For transient conditions in which combustion chamber temperature Tcc increases (portions 332 and 334 of the curve of FIG. 3C), spark (ignition) timing decreases first through a significant step decrease at portion 362 of the curve of FIG. 3E, and the gradually moves toward a final steady state timing along curve portions 364, 366, and 370. Likewise, under transient conditions in which combustion chamber temperature Tcc decreases (portions 326 and 328 of the curve of FIG. 3C), spark (ignition) timing increases first through a significant step increase at portion 350 of the curve of FIG. 3E, and the gradually moves toward a final steady state timing along curve portions 352, 254, and 360.

Returning to FIG. 2, it should be pointed out that for relatively stable engine operating conditions in which Tcc is substantially constant, the determination of SPK(K) is substantially that of a steady state spark timing determination. Following the determination of the timing value SPK(K) at the step 220, the timing value is next output, at a step 222, as signal EST to ignition controller 38 of FIG. 1 for timed issuance to a next active spark plug to provide for ignition of an air/fuel mixture in an engine cylinder substantially at the end of a compression stroke of a corresponding piston. Following issuance of the ignition timing value, current ignition timing values are relabelled at a step 224 for use in subsequent iterations of the operations of FIG. 2. Specifically, SPK(K) is relabelled as SPK(K−1) and $SPK_{ss}(K)$ is relabelled as $SPK_{ss}(K-1)$, and such relabelled values are next stored, at a step 226 in random access memory RAM 26 of FIG. 1. Additional control, diagnostic or maintenance operations, such as conventionally understood operations to control engine fueling, or to diagnose powertrain fault conditions, through execution of conventional engine control or diagnostic routines that are required to be executed following occurrence of the current engine cylinder event may next be executed via a step 234, which returns PCM authority to such operations, or to any other operations that may be conventionally required.

The preferred embodiment for the purpose of explaining this invention is not to be taken as limiting or restricting the invention since many modifications may be made through the exercise of ordinary skill in the art without departing from the scope of the invention.

The embodiments of the invention in which a property or privilege is claimed are described as follows:

1. An engine ignition timing control method for controlling a time of ignition of an air/fuel mixture in an internal combustion engine cylinder combustion chamber, comprising the steps of:

sensing a change in an engine operating condition from an initial engine operating condition to a final engine operating condition;

modeling a combustion chamber temperature change profile between an initial combustion chamber corresponding to the initial engine operating condition and a final combustion chamber temperature corresponding to the final engine operating condition;

establishing an ignition timing command change profile between an initial timing command corresponding to the initial engine operating condition and a final ignition timing command corresponding to the final engine operating condition as a function of the temperature change profile;

varying an ignition timing command in accordance with the established ignition timing command change profile; and applying the ignition timing command to an engine ignition system for controlling the time of ignition of the air/fuel mixture in the engine cylinder combustion chamber.

2. The method of claim 1, wherein the modeling step models the combustion chamber temperature change profile as substantially a lead-lag temperature change profile.

3. The method of claim 2, wherein the combustion chamber temperature change profile comprises an initial step change in temperature followed by a predetermined lag temperature change profile.

4. The method of claim 3, wherein the predetermined lag temperature change profile is a first order lag profile.

5. The method of claim 1, further comprising the step of detecting predetermined engine cylinder events, and wherein the sensing step is carried out following detection of predetermined engine cylinder events.

6. An internal combustion engine ignition timing control method for varying a time of an ignition event in an engine combustion chamber, comprising the steps of:

detecting occurrence of repeated predetermined engine cylinder events;

following the detected occurrences, (a) sampling input signals indicating engine parameter values;

(b) determining a current engine operating condition as a predetermined function of the sampled input signals;

(c) detecting a transition between the current and a prior engine operating condition;

(d) characterizing a combustion chamber temperature change trajectory between a first temperature corresponding to the prior engine operating condition and a second temperature corresponding to the current engine operating condition;

(e) generating an ignition timing command change trajectory between a first timing command corresponding to the first temperature and a second timing command corresponding to the second temperature as a function of the combustion chamber temperature change trajectory; and (f) varying the time of the ignition event in accordance with the ignition timing command change trajectory.

7. The method of claim 6, wherein the sampling step samples input signals indicating engine speed and engine load.

8. The method of claim 6, wherein the combustion chamber temperature change trajectory is substantially a lead-lag trajectory.

9. The method of claim 6, wherein the combustion chamber temperature change trajectory comprises a step change trajectory followed by a predetermined lag change trajectory.

10. The method of claim 9, wherein the predetermined lag change trajectory is substantially a first order lag trajectory.

* * * * *